US012710228B2

(12) United States Patent
Golubev et al.

(10) Patent No.: US 12,710,228 B2
(45) Date of Patent: Aug. 18, 2026

(54) METHOD AND PLANT FOR LOW TEMPERATURE FRACTIONATION OF AIR

(71) Applicant: LINDE GMBH, Pullach (DE)

(72) Inventors: Dimitri Golubev, Pullach (DE); Xiaohua Fan, Pullach (DE)

(73) Assignee: Linde GmbH, Pullach (DE)

( * ) Notice: Subject to any disclaimer, the term of this patent is extended or adjusted under 35 U.S.C. 154(b) by 295 days.

(21) Appl. No.: 18/554,396

(22) PCT Filed: Mar. 10, 2022

(86) PCT No.: PCT/EP2022/025098
§ 371 (c)(1),
(2) Date: Oct. 6, 2023

(87) PCT Pub. No.: WO2022/214214
PCT Pub. Date: Oct. 13, 2022

(65) Prior Publication Data

US 2024/0183610 A1 Jun. 6, 2024

(30) Foreign Application Priority Data

Apr. 9, 2021 (EP) ..... 21020190

(51) Int. Cl.
*F25J 3/00* (2006.01)
*F25J 3/04* (2006.01)

(52) U.S. Cl.
CPC ..... *F25J 3/04393* (2013.01); *F25J 3/04054* (2013.01); *F25J 3/0423* (2013.01); *F25J 3/04236* (2013.01); *F25J 3/04315* (2013.01); *F25J 3/04321* (2013.01); *F25J 3/0443* (2013.01); *F25J 3/0486* (2013.01); *F25J 2200/20* (2013.01); *F25J 2210/42* (2013.01); *F25J 2215/56* (2013.01);
(Continued)

(58) Field of Classification Search
CPC .. F25J 3/04393; F25J 3/04321; F25J 3/04066; F25J 2245/50; F25J 2215/56
See application file for complete search history.

(56) References Cited

U.S. PATENT DOCUMENTS 4,783,210 A * 11/1988 Ayres ..... F25J 3/04284 62/651
6,279,345 B1 * 8/2001 Arman ..... F25J 3/04278 62/647
(Continued)

FOREIGN PATENT DOCUMENTS

EP 1995537 A2 11/2008
JP 2917031 B2 7/1999
(Continued)

*Primary Examiner* — Brian M King
(74) *Attorney, Agent, or Firm* — Millen, White, Zelano & Branigan, P.C.; Brion P. Heaney

(57) ABSTRACT

A SPECTRA process for low-temperature fractionation of air is proposed, in which bottoms liquid from an additional second rectification column used to obtain oxygen is evaporated in a second condenser evaporator arrangement. In this second condenser evaporator arrangement, gas that has been evaporated beforehand in a first condenser evaporator arrangement, which is used for condensation of tops gas from a first rectification column, is partially condensed after recompression. The invention also relates to a corresponding plant.

19 Claims, 4 Drawing Sheets

(52) U.S. Cl.
CPC ..... *F25J 2240/04* (2013.01); *F25J 2245/02* (2013.01); *F25J 2245/42* (2013.01); *F25J 2250/02* (2013.01); *F25J 2250/20* (2013.01); *F25J 2270/02* (2013.01)

(56) References Cited

U.S. PATENT DOCUMENTS

| | | | | |
|---|---|---|---|---|
| 2003/0109948 | A1* | 6/2003 | Phelps | F25J 3/04412 700/98 |
| 2008/0289362 | A1* | 11/2008 | Lochner | F25J 3/0409 62/651 |
| 2016/0178060 | A1* | 6/2016 | Newhouse | B60R 13/07 277/345 |
| 2017/0205142 | A1* | 7/2017 | Lochner | F25J 3/04284 |
| 2018/0017322 | A1* | 1/2018 | Golubev | F25J 3/04412 |

FOREIGN PATENT DOCUMENTS

| | | | | |
|---|---|---|---|---|
| JP | 2004020158 | A * | 1/2004 | F25J 3/04284 |
| WO | 2021104668 | A1 | 6/2021 | |

* cited by examiner

METHOD AND PLANT FOR LOW TEMPERATURE FRACTIONATION OF AIR

The invention relates to a process for the low-temperature fractionation of air and to a corresponding plant in accordance with the preambles of the independent claims.

PRIOR ART

The production of air products in the liquid or gaseous state by cryogenic fractionation of air in air fractionation plants is known and described, for example, in H.-W. Haring (editor), Industrial Gases Processing, Wiley-VCH, 2006—in particular, Section 2.2.5, "Cryogenic Rectification."

Air fractionation plants have rectification column systems which, for example, can conventionally be designed as two-column systems, and in particular as classical Linde double-column systems, but also as triple-column or multi-column systems. In addition to the rectification columns for extracting nitrogen and/or oxygen in the liquid and/or gaseous state, i.e., rectification columns for nitrogen-oxygen separation, rectification columns for extracting further air components, and in particular the noble gases krypton, xenon, and/or argon, can be provided. Frequently, the terms, "rectification" and "distillation" as well as "column [Säule]" and "column [Kolonne]," or terms composed therefrom are used synonymously.

The rectification columns of the mentioned rectification column systems are operated at different pressure levels. Known double-column systems have what is known as a high-pressure column (also referred to as a pressure column, medium- pressure column, or lower column) and what is known as a low-pressure column (also referred to as an upper column). The high-pressure column is typically operated at a pressure level of 4 to 7 bar or 3 to 7 bar, and in particular approximately 5.3 bar. The low-pressure column is operated at a pressure level of typically 1 to 2 bar, and in particular approximately 1.4 bar. In certain cases, even higher pressure levels may be used in either rectification column. The pressures cited here and below are absolute pressures at the top of the respective columns indicated.

So-called SPECTRA processes are known from the prior art for providing pressurized nitrogen as the main product. They are explained in more detail below. In a SPECTRA process, a so-called oxygen column, which can be operated at or above the pressure level of a typical low-pressure column, can be used to obtain pure or high-purity oxygen. This low-pressure column is present in addition to the rectification column used for nitrogen extraction and is fed therefrom.

The object of the present invention is to improve a SPECTRA process with corresponding oxygen extraction, primarily with regard to energy consumption and material yield.

DISCLOSURE OF THE INVENTION

Against this background, the present invention proposes a process for the low-temperature fractionation of air and a corresponding plant with the features of the independent claims. Preferred embodiments form the subject matter of the dependent claims and of the following description.

Prior to explaining the features and advantages of the present invention, some of the principles of the present invention will be explained in greater detail, and terms used below will be defined.

The devices used in an air fractionation plant are described in the cited technical literature—for example, in Haring (see above) in Section 2.2.5.6, "Apparatus." Unless the following definitions differ, reference is therefore explicitly made to the cited technical literature with respect to terminology used in the context of the present application.

Liquids and gases may, in the terminology used herein, be rich or poor in one or more components, wherein "rich" can refer to a content of at least 75%, 90%, 95%, 99%, 99.5%, 99.9%, or 99.99%, and "poor" can refer to a content of at most 25%, 10%, 5%, 1%, 0.1%, or 0.01% on a mole, weight, or volume basis. The term, "predominantly," can correspond to the definition of "rich." Liquids and gases may also be enriched in or depleted of one or more components, wherein these terms refer to a content in a starting liquid or a starting gas from which the liquid or gas has been extracted.

The liquid or the gas is enriched if it contains at least 1.1 times, 1.5 times, 2 times, 5 times, 10 times, 100 times, or 1,000 times the content, and depleted if it contains at most 0.9 times, 0.5 times, 0.1 times, 0.01 times, or 0.001 times the content of a corresponding component, based upon the starting liquid or the starting gas. If, for example, reference is made here to "oxygen," "nitrogen," or "argon," this is also understood to mean a liquid or a gas which is rich in oxygen or nitrogen but need not necessarily consist exclusively thereof.

The present application uses the terms, "pressure level" and "temperature level," to characterize pressures and temperatures, which means that corresponding pressures and temperatures in a corresponding plant do not have to be used in the form of exact pressure or temperature values in order to realize the inventive concept. However, such pressures and temperatures typically fall within certain ranges, which are, for example, 1%, 5%, 10%, or 20% around an average. In this case, corresponding pressure levels and temperature levels can be in disjointed ranges or in ranges that overlap one another. In particular, pressure levels, for example, include unavoidable or expected pressure losses. The same applies to temperature levels. The pressure levels indicated here in bar are absolute pressures.

Where "expansion machines" are mentioned here, these refer to typically known turboexpanders. These expansion machines can, in particular, also be coupled to compressors. These compressors may in particular be turbocompressors. A corresponding combination of turboexpander and turbocompressor is typically also referred to as a "turbine booster." In a turbine booster, the turboexpander and the turbocompressor are mechanically coupled, wherein the coupling may take place at the same rotational speed (for example, via a common shaft) or at different rotational speeds (for example, via suitable gearing). In general, the term, "compressor," is used herein. Here, a "cold compressor" refers to a compressor to which a fluid stream is supplied at a temperature level significantly below 0° C., and in particular below −50, −75, or −100° C. and down to −150 or −200° C. A corresponding fluid stream is cooled to a corresponding temperature level in particular by means of a main heat exchanger (see below).

A "main air compressor" is characterized in that it compresses all of the air supplied to the air fractionation plant and separated there. In contrast, in one or more optionally provided further compressors, e.g., booster compressors, only a portion of this air that has already been previously compressed in the main air compressor is further compressed. Accordingly, the "main heat exchanger" of an air fractionation plant represents the heat exchanger in which at least the predominant part of the air supplied to the air fractionation plant and separated there is cooled. This takes place at least in part and possibly only in counterflow to material streams that are discharged from the air fractionation plant. In the terminology used herein, material streams or "products" "discharged" from an air fractionation plant are fluids that no longer participate in circuits within the plant, but are permanently removed therefrom.

A "heat exchanger" for use in the context of the present invention can be designed in a manner customary in the art. It serves for the indirect transfer of heat between at least two fluid streams which are, for example, conducted in counterflow to one another—for example, a warm compressed air stream and one or more cold fluid streams or a cryogenic liquid air product and one or more warm or warmer, but possibly also even cryogenic, fluid streams. A heat exchanger can be formed from one or more heat exchanger sections connected in parallel and/or serially, e.g., from one or more plate heat exchanger blocks. It is, for example, a plate fin heat exchanger. Such a heat exchanger has "passages" which take the form of fluid channels separated from one another and having heat exchange surfaces, and which are connected together in parallel and separated by other passages to form "passage groups." Characteristic of a heat exchanger is that, at one time point, heat is exchanged therein between two mobile media, viz., at least one fluid stream to be cooled and at least one fluid stream to be heated.

A "condenser evaporator" refers to a heat exchanger in which a condensing fluid stream enters into indirect heat exchange with an evaporating fluid stream. Each condenser evaporator has a liquefaction chamber and an evaporation chamber. The liquefaction and evaporation chambers have liquefaction or evaporation passages. Condensation (liquefaction) of the condensing fluid stream is carried out in the liquefaction chamber, and evaporation of the evaporating fluid stream is carried out in the evaporation chamber. The evaporation and liquefaction chambers are formed by groups of passages, which are in a heat-exchanging relationship with one another. A "condenser evaporator arrangement" in the terminology used here can comprise one or more condenser evaporators.

A condenser evaporator of a condenser evaporator arrangement can be designed for use in the present invention, for example, as a so-called bath evaporator, which is well known to the person skilled in the art. In a bath evaporator, liquid to be evaporated rises through evaporation passages of the condenser evaporator due to the thermosiphon effect. Alternatively, a so-called "enhanced-flow" or forced-flow condenser evaporator can also be used, in which a liquid or two-phase flow is pressed by means of its own pressure through the evaporation chamber and is partially or completely evaporated there. This pressure can be generated, for example, by a liquid column in the feed line to the evaporation chamber. The height of this liquid column here corresponds to the pressure loss in the evaporation chamber.

The present invention comprises the low-temperature fractionation of air according to the so-called SPECTRA process, as described, inter alia, in EP 2 789 958 A1 and the further patent literature cited therein. In its simplest form, this process is a single-column process. However, in the context of the present invention, this is not the case, because here, in addition to an air-fed rectification column ("first" rectification column), a rectification column fed from the first rectification column and used for oxygen extraction ("second" rectification column) is used.

While the SPECTRA process was originally intended to provide gaseous nitrogen at the pressure level of the first rectification column, the use of a second rectification column of the type explained enables the additional extraction of pure oxygen.

As in other processes for the low-temperature fractionation of air, compressed and pre-purified air is also cooled in the SPECTRA process to a temperature suitable for rectification. It can thereby be partially liquefied by conventional processes. The air is rectified at the typical pressure of a high-pressure column, as explained at the outset, yielding the tops gas enriched in nitrogen in comparison to atmospheric air and a liquid bottoms liquid enriched in oxygen in comparison to atmospheric air.

A return flow of the first rectification column used for this purpose is provided in a heat exchanger by condensing tops gas of the first rectification column—more precisely, a portion of this tops gas. In this heat exchanger—a condenser evaporator that is part of a corresponding condenser evaporator arrangement (referred to here as the "first" condenser evaporator)—fluid, which is likewise taken from the first rectification column, is used for cooling and thereby evaporated or partially evaporated. Further tops gas may be provided as a nitrogen-rich product. As mentioned, a corresponding condenser evaporator arrangement may have one or more condenser evaporators.

In the variant of the SPECTRA process used according to the invention, two material streams ("first" and "second" material streams) are formed in the first condenser evaporator arrangement by evaporating liquid from the first rectification column, wherein, in one embodiment of the invention, the first material stream is formed using liquid taken from the first rectification column with a first oxygen content, and the second material stream is formed using liquid taken from the first rectification column with a second, higher oxygen content. In this embodiment, the liquid used to form the first material stream can be taken from the first rectification column from an intermediate tray or from a liquid retention device. In this embodiment, the liquid used to form the second material stream can in particular be at least a portion of the liquid bottoms product of the first rectification column.

In another embodiment, however, the same liquid can also initially be used to form the first and second material streams—for example, bottoms liquid from the first rectification column or another liquid taken from the first rectification column. This can be conducted through the first condenser evaporator arrangement, in this case partially evaporated, and subjected to a phase separation to obtain a gas fraction and a liquid fraction. In this embodiment, the first material stream can be formed with the first oxygen content using the gas fraction or a portion thereof.

In one embodiment of the invention, the condenser evaporator arrangement may have only one condenser evaporator. In this embodiment, the second material stream can be formed by evaporation of the liquid fraction or a portion thereof in the one condenser evaporator of the first condenser evaporator arrangement. The first and second material streams are fluid which is used beforehand in the first condenser evaporator arrangement for cooling and for condensing the corresponding portion of tops gas from the first rectification column.

However, it is also possible to use two, spatially separated condenser evaporators in the first condenser evaporator arrangement. In this embodiment of the invention, the bottoms liquid from the first rectification column can initially be conducted through a condenser evaporator of the first condenser evaporator arrangement, partially evaporated in the process, and subjected to a phase separation to obtain a gas fraction and a liquid fraction. In this embodiment, the first material stream can be formed with the first oxygen content using the gas fraction or a portion thereof. The liquid remaining after the first evaporation is conducted into another condenser evaporator of the first condenser evaporator arrangement and is evaporated there completely or almost completely. In this embodiment, the second material stream can be formed by evaporation of this liquid or a portion thereof. In this embodiment, the first condenser evaporator arrangement can thus be divided practically into two smaller units, and preferably connected in parallel on the condensation side.

In general, in a SPECTRA process, after being used in the first condenser evaporator arrangement for cooling, the first material stream can be at least partially compressed by means of a cold compressor and returned to the first rectification column. This is also the case in the context of the present invention. In a SPECTRA process, after being used in the first condenser evaporator arrangement for cooling, the second material stream may be at least partially expanded and discharged from the air fractionation plant as a so-called residual gas mixture. For the compression of the first material stream (or a corresponding portion), one or more compressors can be used which are coupled to one or more expansion machines in which the expansion of the second material stream (or a corresponding portion) is carried out. It is understood that only portions of the first or second material stream may also in each case be compressed or expanded in the correspondingly coupled units. An expansion machine that is not coupled to a corresponding compressor can, if present, be braked in particular mechanically and/or by generator. Braking is also possible in the case of an expansion machine that is coupled to a compressor.

For example, a compressor that is coupled to one of two expansion machines arranged in parallel can be used. If only one expansion machine is used, the compressor can be coupled thereto. The wording, used below only for reasons of clarity, according to which "a" compressor is coupled to "an" expansion machine, does not preclude the use of several compressors and/or expansion machines in any mutual coupling. However, the compressor or compressors described do not have to be driven—in particular, not exclusively by means of the one or more expansion machines mentioned. Conversely, the compressor or compressors also do not have to take up all of the work released during expansion. As also illustrated below by way of example, a supporting or exclusive drive can also be effected, for example, by using an electric motor, or generator and/or oil brakes can be provided in any arrangement.

The compressor or compressors are one or more cold compressors, since the compressor or compressors are supplied with the first fluid stream despite its routing through the first condenser evaporator arrangement and an optionally subsequent further heating to a low temperature level.

In the SPECTRA processes just explained with oxygen extraction, a further condenser evaporator arrangement ("second" condenser evaporator arrangement) is typically present in the lower region of the second rectification column and is used to bring bottoms liquid in the second rectification column to boil. This condenser evaporator arrangement comprises a single condenser evaporator and is conventionally operated with air (feed air) that is compressed (at least) in the main air compressor and cooled in the main heat exchanger, and which is supplied to the first rectification column. In particular, this feed air can also be air that is initially present in gaseous form and is liquefied in the second condenser evaporator arrangement before it is fed into the first rectification column. It is a portion of the feed air supplied overall to the first rectification column. Further (gaseous) feed air can be fed into the first rectification column without any corresponding liquefaction.

The costs for obtaining high-purity liquid or gaseous oxygen products (LOX, GOX; in the high-purity state, also referred to as UHPLOX or UHPGOX) are comparatively high in known SPECTRA processes. The reason for this is, on the one hand, a relatively high outlay on equipment and, on the other, an additional energy requirement associated therewith which can considerably influence the efficiency of the overall process.

The reason for the high specific energy requirement is mainly that, in the aforementioned second condenser evaporator arrangement in the lower region of the second rectification column, the explained "heating" is realized to a large extent by the aforementioned condensation of the portion of the gaseous feed air. Although this (liquefied) partial air stream is subsequently (after its evaporation) used for generating cooling capacity or for driving the cold compressor (s) used, in that a corresponding quantity of fluid is taken as the second material stream from the first rectification column, said partial air stream does, however, not participate further in the rectification process in the first rectification column. This leads to a strong reduction in the product yield of nitrogen, since a return flow, lacking here, to the first rectification column must be generated by a fractionation of additional air. The high driving temperature difference in the second condenser evaporator arrangement in the lower region of the second rectification column (condensation of the air here takes place at the highest pressure in the rectification column system) leads to additional thermodynamic losses in the process. Especially in the case of relatively large quantities of UHPGOX or UHPLOX products, these disadvantages have a great effect on the power consumption of the main air compressor.

In an embodiment not according to the invention, a process of the type explained above can be modified in that, instead of a feed air stream in the second condenser evaporator arrangement in the lower region of the second rectification column, fluid is used which has been evaporated in the manner explained above as part of the "first" or "second" material stream in the first condenser evaporator arrangement. In this way, the air previously used for this purpose can be saved, thereby increasing energy efficiency and yield. The condensed fluid can then be treated as explained below.

In such an embodiment, the condensation in the second condenser evaporator arrangement can be carried out at a pressure level at which the evaporation of the corresponding fluid in the first condenser evaporator arrangement was previously carried out. In this way, recompression can be dispensed with, and the condensed gas or the condensate formed can be brought to the required pressure by means of a pump. In contrast to a gas compressor, the operation of a pump is much more reliable, and its provision is significantly more cost-effective. Nevertheless, operation is also to be sought without a corresponding pump. The present invention ensures this.

Due to the aforementioned relatively high pressure level in the second condenser evaporator arrangement, which is achieved in particular by only partial liquefaction of the second material stream, the operating pressure of the second rectification column can also be high enough that energy can be recovered from its tops gas by adding it, according to the invention, to the turbine flow from the first condenser evaporator arrangement (the second material stream). Earlier, the corresponding stream was only throttled off, with high energy loss.

Advantages of the Invention

Overall, in the wording of the claims, the present invention proposes a process for the low-temperature fractionation of air in which an air fractionation plant having a first rectification column and a second rectification column is used. The first rectification column is operated at a first pressure level, and the second rectification column is operated at a second pressure level below the first pressure level.

Such first and second pressure levels are higher pressure levels than those used in conventional air fractionation plants—in particular, in SPECTRA plants with oxygen extraction. The first pressure level may, in particular, be 7 to 14 bar, and the second pressure level may, in particular, be 4 to 7 bar. These are in each case absolute pressures at the top of the respective rectification columns. The first rectification column and the second rectification column can, in particular, be arranged next to one another and are typically not combined with one another in the form of a double column, wherein, here, a "double column" is understood to mean a separator consisting of two rectification columns and designed as a structural unit, in which column jackets of the two rectification columns are connected, and in particular welded, to one another without lines, i.e., directly. However, no fluidic connection needs to be established by this direct connection alone.

The first rectification column used in the context of the present invention and the second rectification column used in the context of the present invention have already been described in detail above with reference to the SPECTRA process. The second rectification column can, in particular, be an oxygen column.

Atmospheric air, which has been compressed and then cooled, is here supplied to the first rectification column. If necessary, corresponding air can be supplied to the first rectification column in the form of several material streams which can be treated differently and optionally have been previously routed through further apparatuses. In contrast, air is not typically supplied to the second rectification column. The second rectification column is fed from the first rectification column, or no material streams that have not already been taken from the first rectification column or formed from such material streams are typically supplied to the second rectification column.

As customary in a SPECTRA process, and in the context of the present invention as well, tops gas of the first rectification column is obtained as a nitrogen product and discharged from the air fractionation plant, and bottoms liquid of the second rectification column is obtained as an oxygen product and discharged from the air fractionation plant. This does not preclude that further fluids can also be discharged from the air fractionation plant and, for example, released into the atmosphere. Fluids otherwise discharged as nitrogen or oxygen products can, in the context of the present invention, also be discharged in certain proportions—for example, as purge streams or as a further liquid nitrogen product after condensation of tops gas of the first rectification column.

In the first condenser evaporator arrangement, in the context of the present invention, the evaporation of liquid from the first rectification column forms a first and a second stream, wherein the evaporation comprises, in particular, two evaporation steps performed separately from one another below the first pressure level at the same or different evaporation pressures. The evaporation pressures in the first condenser evaporator arrangement are in particular 3.5 to 7.5 bara (bar absolute pressure; the values can represent exact or also approximate values), depending upon the first pressure level.

The fluid that is to be evaporated here, which was taken from the first rectification column, is therefore correspondingly expanded. Further tops gas of the first rectification column, which is not provided as a gaseous nitrogen product, is condensed in the first condenser evaporator arrangement and returned to the first rectification column as a return flow. A proportion of corresponding condensate can also be discharged as the further liquid nitrogen product mentioned—in particular, after supercooling against itself.

The first material stream is formed according to the invention with a first oxygen content, and the second material stream is formed according to the invention with a second oxygen content above the first oxygen content. In one embodiment, the first material stream evaporated in the first condenser evaporator arrangement can be formed by evaporating liquid already taken from the first rectification column with the first oxygen content, and, in this embodiment, the second material stream can be formed using liquid already taken from the first rectification column with the second oxygen content above the first oxygen content. Further explanations relating to such liquids have already been given. In this embodiment, the liquid with the first, lower oxygen content is in particular liquid that is extracted at an intermediate tray or separating tray of the first rectification column or of a corresponding liquid retention device. In this embodiment, the liquid with the second, higher oxygen content is in particular bottoms liquid of the first rectification column. Another embodiment provides for forming the first and second material streams using the same liquid from the first rectification column, as already explained above.

In the context of the present invention, the first material stream or a portion thereof is partly or completely subjected to recompression to the first pressure level and fed into the first rectification column, and the second material stream or a portion thereof is subjected to expansion and discharged from the air fractionation plant.

The second rectification column is equipped with or at least thermally coupled to the second condenser evaporator arrangement, wherein the second condenser evaporator arrangement is designed or provided in particular in a bottoms region of the second rectification column and is in particular partially immersed in a liquid bath forming in the bottoms region. The bottoms liquid of the second rectification column is here evaporated in the second condenser evaporator arrangement.

According to the invention, the first material stream or the portion thereof that is subjected to the recompression to the first pressure level and is fed into the first rectification column is subjected to partial liquefaction or condensation using the second condenser evaporator arrangement after the recompression to the first pressure level and before being fed into the first rectification column.

Advantages of the present invention have already been addressed. The advantage of the interconnection provided according to the invention is in particular that, in order to obtain identical products, in total of up to approximately 4.7% less feed air (or, accordingly, approximately 4.7% less energy) is required, wherein, for example, a quantity of 29,300 standard cubic meters per hour of pressurized nitrogen (PGAN) at approximately 11 bara and 700 standard cubic meters per hour of high-purity liquid oxygen (UHPLOX) can be provided. This can be attributed in particular to the fact that, in the context of the present invention, no air is used to heat the second condenser evaporator arrangement, and the disadvantages explained above are thus overcome. In the context of the present invention, the specific energy requirement is reduced, because all of the air used takes part in the rectification process in the first rectification column, and the product yield of nitrogen is thus increased. A further advantage arises in particular when tops gas from the second rectification column, which represents a so-called "residual gas," is subjected to the aforementioned expansion together with the second material stream or a corresponding portion thereof and is discharged from the air fractionation plant. This makes it possible to dispense with a (separate) throttling of this residual gas, and instead use the corresponding energy.

A particular further advantage of the present invention is that, for the return of the condensate formed in the second condenser evaporator arrangement, no pump is required, and, as a result, the investment and operating costs can be reduced, and the plant becomes more maintenance-friendly.

Two alternatives of the invention relate in particular to the specific type of partial condensation of the first material stream or of the portion thereof which is subjected to the recompression to the first pressure level and is fed into the first rectification column.

In a first embodiment, a first fraction of the first material stream or the portion thereof which is subjected to the recompression to the first pressure level and is fed into the first rectification column is conducted through the second condenser evaporator arrangement, liquefied there at least to a predominant extent, and in particular completely, and fed into the first rectification column, and a second fraction of the first material stream or the portion thereof which is subjected to the recompression to the first pressure level and is fed into the first rectification column is fed unliquefied into the first rectification column, without being conducted through the second condenser evaporator arrangement.

In a second embodiment, the first stream or the portion thereof which is subjected to the recompression to the first pressure level and is fed into the first rectification column is conducted through the second condenser evaporator arrangement, but is only partially liquefied there, and the first rectification column is fed in the form of a two-phase stream. The two-phase stream can in particular have a vapor fraction of 0.7 to 0.95, e.g., about 0.8, in molar fractions and relative to its total quantity.

The introduction of the first material stream or of the portion thereof which is subjected to the recompression to the first pressure level and is fed into the first rectification column, or the liquid and gaseous fraction after partial liquefaction, can take place at least in part into a lower region of the first rectification column. Such a "lower region" can be a position below which there are no more separation devices such as sieve trays or packings located in the first rectification column.

In principle, the pressurized nitrogen product from the first rectification column could also be used to heat the second condenser evaporator arrangement and be subjected to corresponding condensation. However, in order to not impair its purity, a correspondingly contaminant-free pump would have to be used for further conveyance of the liquid formed. Due to the outlay associated therewith, this is extremely disadvantageous in comparison to the solutions proposed according to the invention. The energy advantage would also be noticeably lower than in the solution according to the invention.

In all of the embodiments of the invention, tops gas from the second rectification column can be fed to the second material stream or to the portion thereof which is subjected to the work-performing expansion and is discharged from the air fractionation plant, or to a corresponding portion thereof, before the work-performing decompression thereof. Alternatively or additionally, however, it is also possible to subject the or further tops gas from the second rectification column to a work-performing expansion separately from the second material stream or the portion thereof which is subjected to the work-performing expansion and is discharged from the air fractionation plant. In the latter case, an expander in the form of an additional expansion machine or corresponding to a second turbine present in known processes can be used in particular.

The first material stream or the portion thereof which is subjected to the recompression to the first pressure level and is fed into the first rectification column is brought, during the recompression, in particular to a third pressure level, which corresponds to at least the first pressure level, wherein the partial liquefaction takes place in particular at the first pressure level minus pressure losses in the main heat exchanger and the connecting lines.

A particular advantage of the invention consists, as mentioned, in that the first material stream or the portion thereof which is subjected to the recompression to the first pressure level and is fed into the first rectification column, or the liquid and gaseous portions formed or remaining during the partial liquefaction, is or are transferred to the first rectification column without a pump.

As known in this respect with SPECTRA processes, in the context of the present invention, it is also possible for one or more compressors to be provided for the recompression of the first material stream or of the portion thereof which is subjected to the recompression to the first pressure level and is fed into the first rectification column, and for one or more expansion machines, which are coupled to the one or more compressors, to be provided for the work-performing expansion of the second material stream or of the portion thereof which is subjected to the work-performing expansion and is discharged from the air fractionation plant. Further details of SPECTRA processes have already been explained in general terms above.

With the process according to the invention, a tops gas of the first rectification column, and thus a nitrogen product, can be obtained with a content of respectively less than 1 ppb oxygen, carbon monoxide, and/or hydrogen and a content of less than 10 ppm argon on a volume basis. In particular, the bottoms liquid of the second rectification column can have a content of less than 10 ppb argon and/or 5 ppm methane on a volume basis and otherwise consist substantially of oxygen.

Advantageously, all cooled compressed air to be fractionated in the process is not or only barely liquefied, and therefore is fed into the first rectification column in at least a predominantly gaseous state.

The present invention also extends to an air fractionation plant which has a first rectification column, a second rectification column, a first condenser evaporator arrangement, and a second condenser evaporator arrangement, and is configured to feed the first rectification column with air and operate it at a first pressure level, and to feed the second rectification column from the first rectification column and operate it at a second pressure level below the first pressure level. The air fractionation plant is additionally configured to extract tops gas from the first rectification column as a nitrogen product and to discharge it from the air fractionation plant, and to extract bottoms liquid from the second rectification column as an oxygen product and to discharge it from the air fractionation plant, to form in the first condenser evaporator arrangement a first and a second material stream below the first pressure level by evaporating liquid from the first rectification column, and to condense further tops gas from the first rectification column in the first condenser evaporator arrangement and return it to the first rectification column as a return flow. The air fractionation plant is further configured to form the first material stream with a first oxygen content and the second material stream with a second oxygen content above the first oxygen content, to subject the first material stream or a part thereof to recompression to the first pressure level and to feed it into the first rectification column, and to subject the second material stream or a part thereof to a decompression and to discharge it from the air fractionation plant, and to evaporate bottoms liquid from the second rectification column in the second condenser evaporator arrangement.

According to the invention, means are provided which are configured to subject the first material stream or the part thereof which is subjected to the recompression to the first pressure level and fed into the first rectification column, after the recompression to the first pressure level and before being fed into the first rectification column, to at least partial liquefaction in the second condenser evaporator arrangement and to feed it into the first rectification column in the form of a two-phase stream, and to supply tops gas from the second rectification column to a work-performing expansion.

Reference is made to the above explanations of the process according to the invention and its embodiments as regards further features and advantages of the air fractionation plant according to the invention, which is configured in particular for carrying out a process as explained above in different embodiments and has corresponding means realized in terms of devices.

The invention is described in more detail hereafter with reference to the accompanying drawings, which illustrate preferred embodiments of the present invention.

In the figures, elements corresponding functionally or structurally to one another are indicated by identical reference signs and, only for the sake of clarity, are not repeatedly explained below.

DETAILED DESCRIPTION OF THE DRAWINGS

Figure 1:
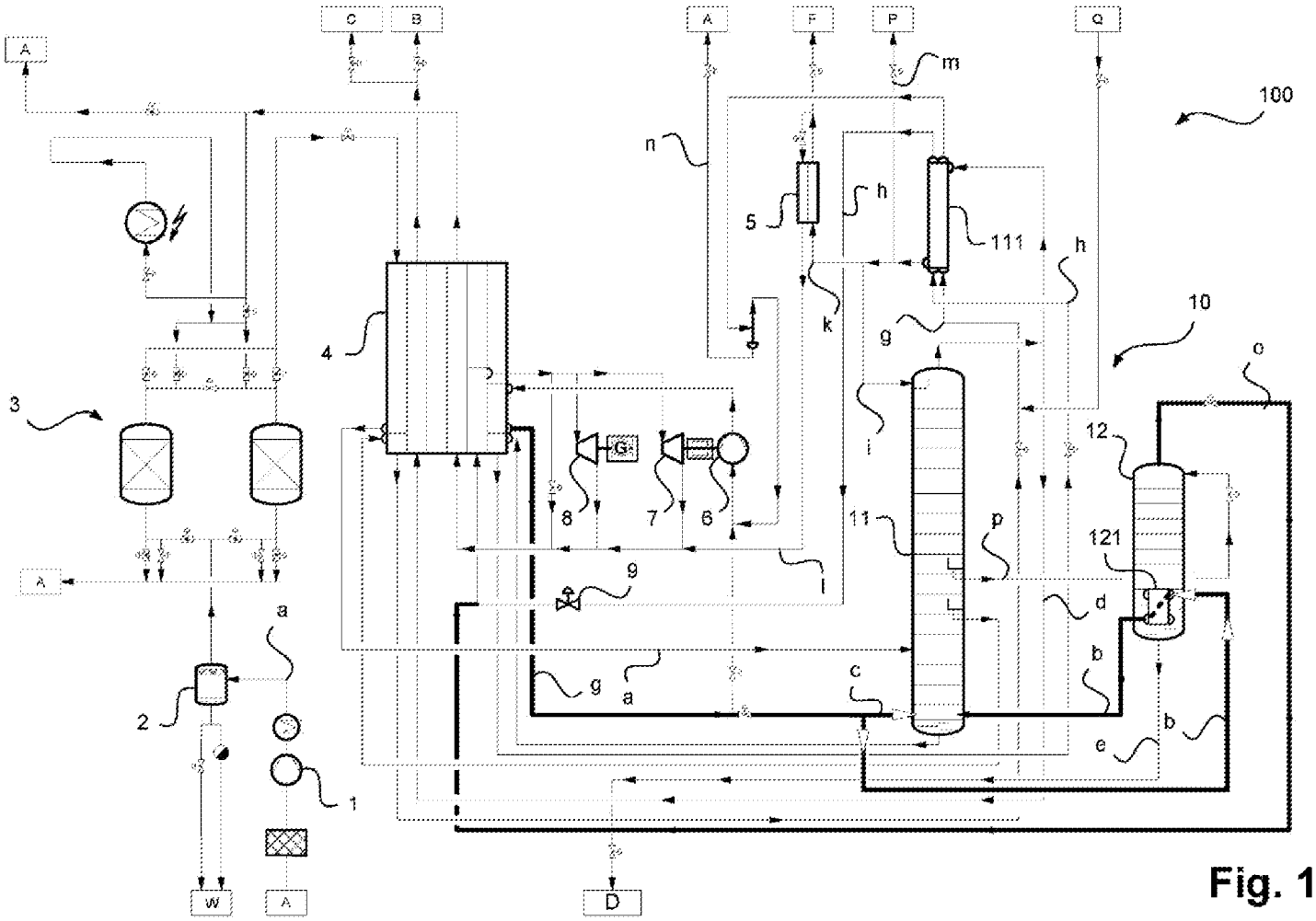
FIG. 1 shows an air fractionation plant according to an embodiment of the invention.

FIG. 1 illustrates an air fractionation plant 100 in the form of a schematic plant diagram. The central component is a rectification column system 10 having a first rectification column 11, a second rectification column 12, a first condenser evaporator 111, and a second condenser evaporator 121.

The first rectification column 11 is operated at a first pressure level, and the second rectification column 12 is operated at a second pressure level below the first pressure level. As mentioned, the first and second condenser evaporators 111 and 121 can each be part of a first or second condenser evaporator arrangement. A first and second condenser evaporator 111, 121 is discussed below simply for the sake of clarity.

By means of a main air compressor 1 of the air fractionation plant 100, air is sucked in from the atmosphere A via a filter (not separately designated) and compressed. After cooling in an aftercooler (likewise not designated separately) downstream of the main air compressor 1, the feed air stream a formed in this way is further cooled in a direct contact cooler 2 operated with water W. The feed air stream a is then subjected to cleaning in an adsorber unit 3. For further explanations in this context, reference is made to the technical literature—for example, in connection with FIG. 2.3A in Haring (see above).

After cooling in the main heat exchanger 4, the feed air stream a is fed into the first rectification column 11. In a conventional process, a portion of the feed air stream a would be fed into the first rectification column 11, whereas a further portion would be routed through the second condenser evaporator 121, which is arranged in a lower region of the second rectification column 12, and evaporated by means of the bottoms liquid of the second rectification column 12. This further portion would be partially condensed in the second condenser evaporator 121 and then likewise fed into the first rectification column 11.

Tops gas of the first rectification column 11 is discharged from the air fractionation plant 100 in the form of a material stream d as a nitrogen product B or sealing gas C. In contrast, bottoms liquid of the second rectification column 12 is discharged in the form of a material stream e as an oxygen product D. It is also possible, for example, to feed into so-called run tanks for later evaporation for the provision of an internally compressed oxygen product D.

In the first condenser evaporator 111, a first material stream g and a second material stream h below the first pressure level (for this purpose, a corresponding expansion in particular takes place in valves which are not denoted separately) are subjected to evaporation in the specific embodiment illustrated here. Further tops gas of the first rectification column 11 is condensed in the form of a material stream i in the first condenser evaporator 111 and returned to the first rectification column 11 as a return flow. As illustrated here in the form of a material stream k, a portion can also be supercooled in a supercooler 5 and provided as liquid nitrogen F. A material stream I heated thereby is treated as explained in more detail below. A further discharge in the form of a purge stream m or P may also be provided. A possible feed of liquid nitrogen (LIN injection) is denoted by Q.

The first material stream g is formed using liquid taken from the first rectification column 11 with a first oxygen content, and the second material stream h is formed using liquid (in particular, bottoms liquid) taken from the first rectification column 11 with a second oxygen content above the first oxygen content.

After its evaporation or partial evaporation in the first condenser evaporator 111, gas of the first material stream g is subjected in a compressor 6 to recompression to the first pressure level and fed into the first rectification column 11. A portion indicated by a dashed line can also be returned to compression in the compressor 6. A portion of the material stream g can also be discharged into the atmosphere A in the form of a material stream n.

After its evaporation or partial evaporation in the first condenser evaporator 111, gas of the second material stream h is partially expanded by a throttle 9 in the example illustrated here, then combined with tops gas, which is taken in the form of a material stream o from the second rectification column 12, subjected to parallel further expansion in expansion machines 7 and 8, and, after heating in the main heat exchanger 4, used as regeneration gas in the adsorber unit 3 or released to the atmosphere A, and thus discharged from the air fractionation plant 100.

The expansion machine 7 is coupled to the compressor 6, and the expansion machine 8 is coupled to a generator G. In each case, a different number of corresponding machines or a different type of coupling may also be used. An (oil) brake (not separately designated) may also be provided.

The second rectification column 12 is fed with a side stream p of the first rectification column 11, which is fed into the second rectification column in an upper region. By means of the second condenser evaporator 121, a first portion of the first material stream g or a corresponding part thereof, after its evaporation or partial evaporation in the first condenser evaporator 111 and after its recompression in the compressor 6, is also conducted as a partial stream b and subjected to partial condensation. Correspondingly formed liquid or two-phase mixture, further denoted by b, is transferred to the first rectification column 11 without a pump. A second portion of the first material stream g or a corresponding part thereof, after evaporation or partial evaporation thereof in the first condenser evaporator 111 and its recompression in the compressor 6, is transferred into the first rectification column 11 as a material stream c in gaseous form and likewise without a pump, without being conducted through the condenser evaporator 121.

Figure 2:
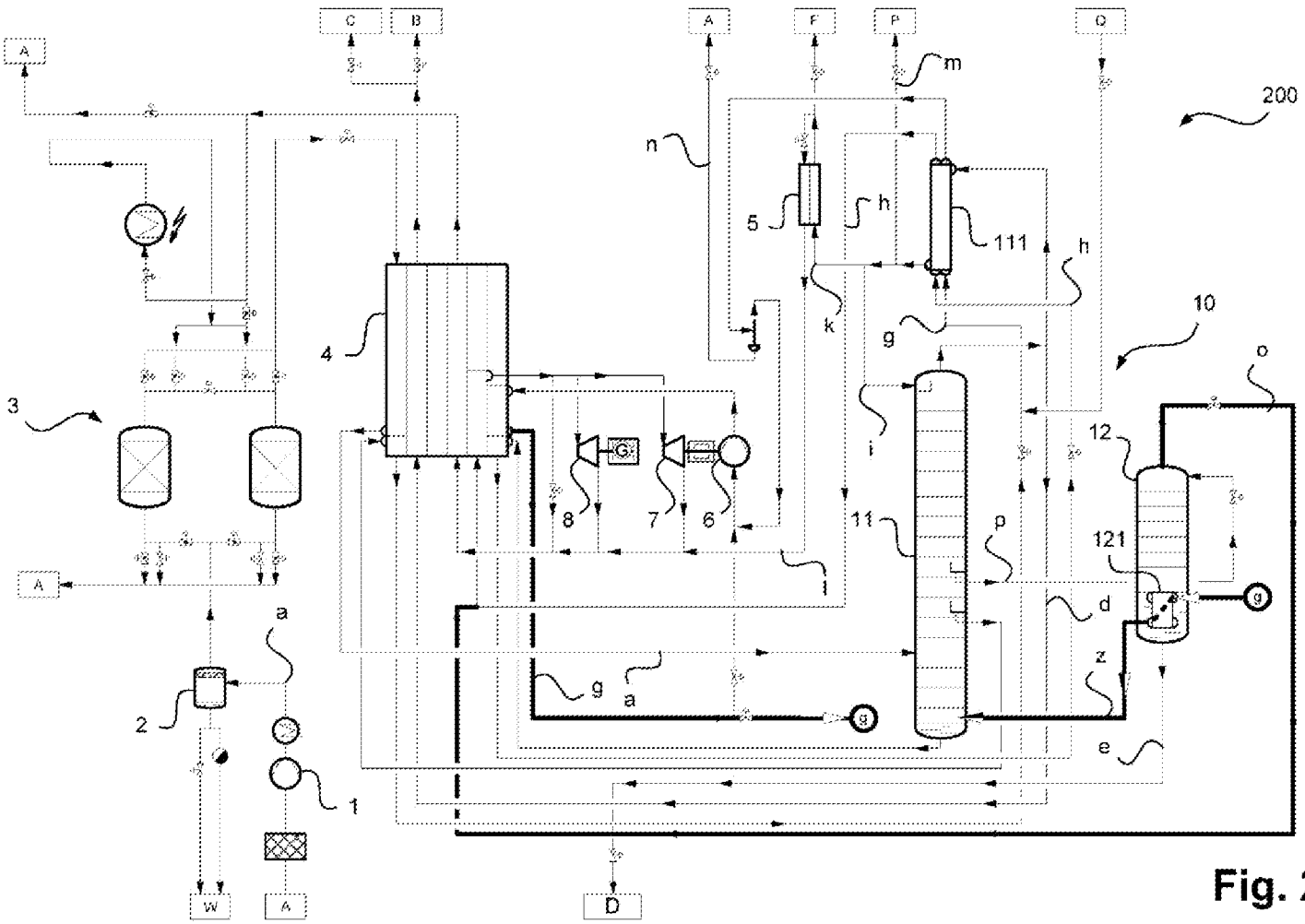
FIG. 2 shows an air fractionation plant according to an embodiment of the invention.

In the otherwise substantially identical or comparable air fractionation plant 200 according to FIG. 2, the first material stream g or a corresponding part thereof, after its evaporation or partial evaporation in the first condenser evaporator 111 and its recompression in the compressor 6, is conducted completely through the second condenser evaporator 121, is partially condensed there, and is transferred to the first rectification column 11 as a two-phase stream, now denoted by z, without a pump. In contrast to the embodiment according to FIG. 1, no throttling of the material stream h at a valve 9, as illustrated above, is carried out here. In this way, the maximum potential can be realized: If the stream h is not throttled, no energy is thereby destroyed, and the powers of both turbines are greater, which is manifested as an energy advantage. This is due in particular to the fact that the partial liquefaction of the stream g allows a higher operating pressure in the second rectification column 12. Accordingly, the throttling of the stream h can either be completely dispensed with (as illustrated in FIG. 2), or this throttling can be noticeably reduced (as not shown separately).

Figure 3:
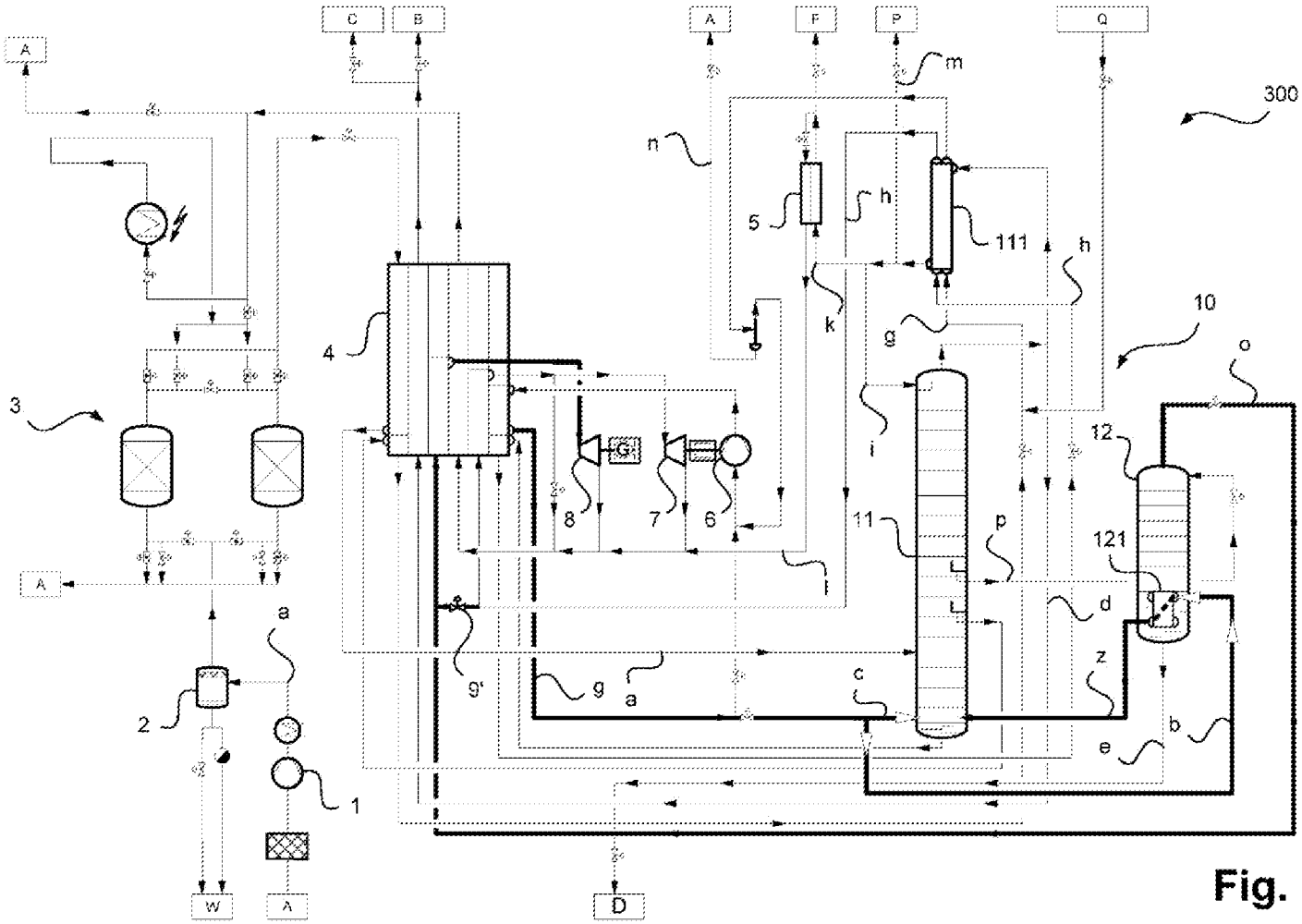
FIG. 3 shows an air fractionation plant according to an embodiment of the invention.

In the air fractionation plant 300 according to FIG. 3, which is otherwise substantially identical or comparable to the air fractionation plant 100 according to FIG. 1, a portion of the material stream h is fed to the material stream o via a throttle 9', before it is heated in the main heat exchanger 3 and expanded in the turbine 8. The remainder of material stream h is likewise heated in the main heat exchanger 4, but expanded in particular in the turbine 7. After combining the expanded material streams, these are combined, heated again in the main heat exchanger 4, and discharged from the plant 300.

Figure 4:
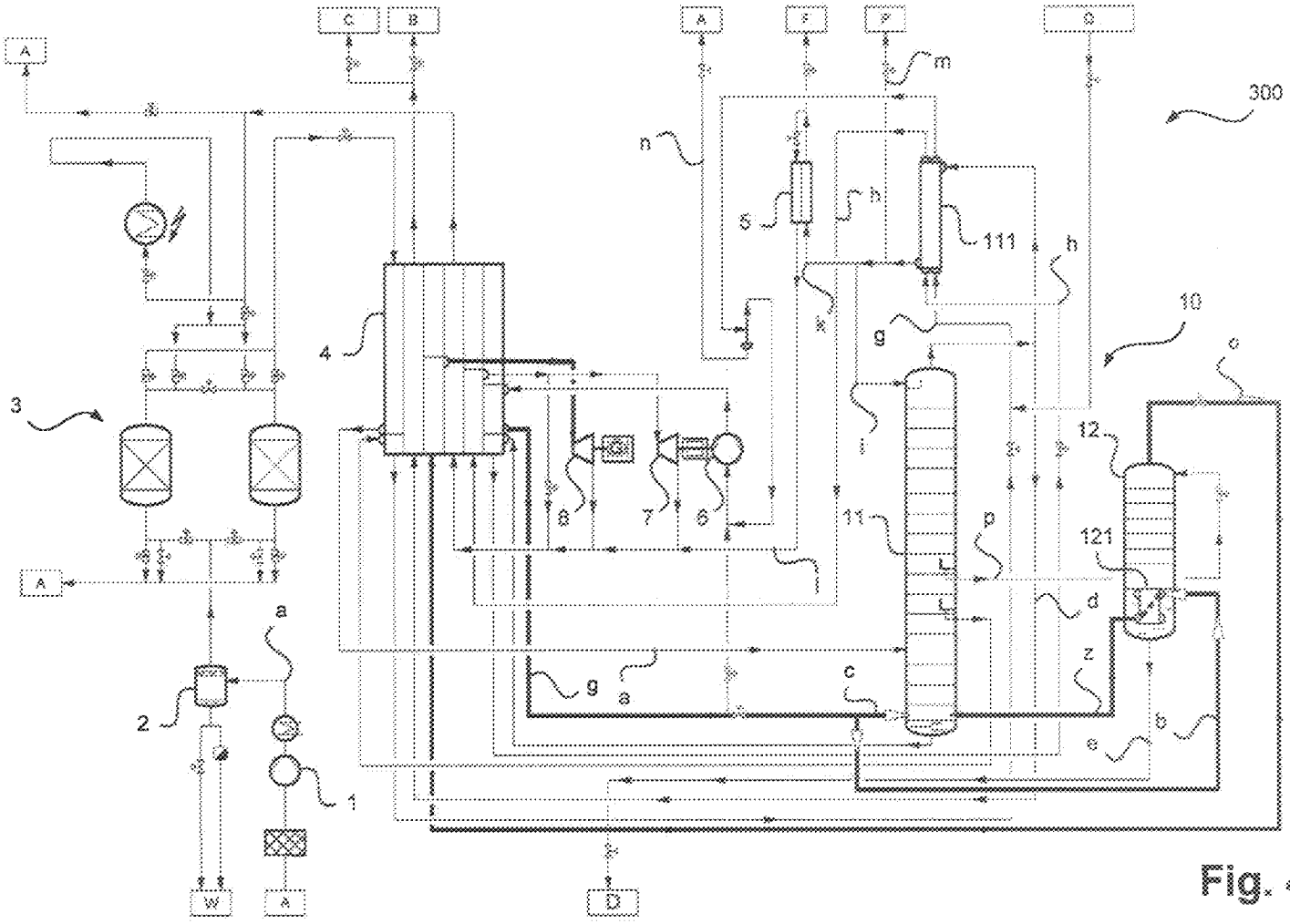
FIG. 4 shows an air fractionation plant according to an embodiment of the invention.

In the air fractionation plant 400 according to FIG. 4, it is provided, in contrast, for example, to the air fractionation plant 100 illustrated in FIG. 1, that the tops gas from the second rectification column in the form of the material stream o be subjected to a work-performing expansion in the turbine 8 separately from the material stream h.

The invention claimed is:

1. A process for the low-temperature fractionation of air in an air fractionation plant having a first rectification column, a second rectification column, a first condenser evaporator arrangement, and a second condenser evaporator arrangement, wherein the process comprises;

feeding air into the first rectification column and feeding a stream from the first rectification column into the second rectification column, wherein the first rectification column is operated at a first pressure level and the second rectification column is operated at a second pressure level which is below the first pressure level, obtaining a first tops gas stream from the first rectification column as a nitrogen product and discharged the nitrogen product from the air fractionation plant, and obtaining bottoms liquid from the second rectification column as an oxygen product and discharged the oxygen product from the air fractionation plant, forming a first material stream and a second material stream, below the first pressure level, in the first condenser evaporator arrangement by evaporating liquid from the first rectification column, and condensing a further tops gas stream from the first rectification column in the first condenser evaporator arrangement and returning the condensed further tops gas stream to the first rectification column as a return flow, wherein the first material stream has a first oxygen content, and the second material stream has a second oxygen content which is above the first oxygen content, at least part of the first material stream to the first pressure level to form a compressed first material stream and feeding the compressed first material stream, into the first rectification column, and subjecting the at least part of the second material stream to work-performing expansion to form an expanded second material stream and discharging the expanded second material stream, from the air fractionation plant, evaporating bottoms liquid from the second rectification column in the second condenser evaporator arrangement, after compression, and before being fed into the first rectification column, subjecting at least a part of the compressed first material stream, to partial liquefaction to form a two-phase stream which is fed to form a two-phase stream which is fed into the first rectification column, and supplying tops gas of the second rectification column to a work-performing expansion.

2. The process according to claim 1, wherein the tops gas of the second rectification column is supplied, upstream of the work-performing expansion, to the at least part of the second material stream which is subjected to the work-performing expansion, and is discharged from the air fractionation plant.

3. The process according to claim 1, wherein tops gas of the second rectification column is subjected to a work-performing expansion, separately from the at least part of the second material stream which is subjected to the work-performing expansion, and is discharged from the air fractionation plant.

4. The process according to claim 1, wherein, in the partial liquefaction in the second condenser evaporator arrangement, 5 to 30 mol %, of the at least part of the compressed first material stream is liquified.

5. The process according to claim 1, wherein all of the compressed first material stream is conducted through the second condenser evaporator arrangement.

6. The process according to claim 1, wherein a first fraction of the compressed first material stream is conducted through the second condenser evaporator arrangement, and fed into the first rectification column, and a second fraction of the compressed first material stream is fed into the first rectification column without being conducted through the second condenser evaporator arrangement.

7. The process according to claim 1, wherein the first rectification column is operated at a first pressure level of 7 to 14 bar, and the second rectification column is operated at a second pressure level of 3 to 7 bar.

8. The process according to claim 7, wherein the partial liquefaction takes place at the first pressure level.

9. The process according to claim 7, wherein the compressed first material stream is transferred to the first rectification column without the use of a pump.

10. The process according to claim 1, wherein one or more compressors are provided for compression of the at least part of the first material stream, and at least one expansion machine are provided for the work-performing expansion of the at least part of the second material stream, and wherein one or more of the expansion machines is coupled to one or more the compressors.

11. The process according to claim 1, wherein the tops gas of the first rectification column contains less than 1 ppb oxygen, less than 1 ppb carbon monoxide, and/or less than 1 ppb hydrogen and contains less than 10 ppm argon, on a volume basis.

12. The process according to claim 1, wherein the bottoms liquid of the second rectification column contains less than 10 ppb argon and/or less than 5 ppm methane, on a volume basis.

13. The process according to claim 1, wherein all of the air to be fractionated in the process is fed into the first rectification column in gaseous form.

14. An air fractionation plant comprising:

a first rectification column, a second rectification column, a first condenser evaporator arrangement, and a second condenser evaporator arrangement, means for feeding air into the first rectification column, operated at a first pressure level, and means for for feeding a stream from the first rectification column into the second rectification column, operated at a second pressure level which is below the first pressure level, means for removing a tops gas stream from the first rectification column and means for discharging the tops gas stream from the air fractionation plant as a nitrogen product, and means for removing a bottoms liquid stream from the second rectification column and discharging the bottoms liquid stream from the air fractionation plant as an oxygen product, a first condenser evaporator arrangement for forming a first material stream with a first oxygen content and a second material stream with a second oxygen content above the first oxygen content below the first pressure level by evaporating liquid from the first rectification column, and means for introducing a further tops gas stream from the first rectification column into the first condenser evaporator arrangement to form a condensate and means for returning the condensate to the first rectification column as a return flow, means for subjecting the first material stream or a part thereof to compression to the first pressure level and means for feeding the compressed first material stream or the compressed part thereof into the first rectification column, and means for subjecting at least part of the second material stream to expansion to form an expanded second material stream and means for discharging the expanded second material stream from the air fractionation plant, a second condenser evaporator arrangement for evaporating bottoms liquid of the second rectification column, means for feeding the compressed first material stream into the second condenser evaporator arrangement located upstream of the means for feeding the compressed first material stream into the first rectification column where the compressed first material stream is configured to undergo partial liquefaction to form a two-phase stream, and means for subjecting a tops gas stream from the second rectification column to a work-performing expansion.

15. The process according to claim 1, wherein, in the partial liquefaction in the second condenser evaporator arrangement, 15 to 25 mol % the at least part of the compressed first material stream, is liquified.

16. The process according to claim 1, wherein the first rectification column is operated at a first pressure level of 7 to 14 bar, and the second rectification column is operated at a second pressure level of 4 to 7 bar.

17. The process according to claim 1, wherein the first rectification column and the second rectification column are not combined with one another in the form of a double column.

18. The process according to claim 1, wherein air is not used to heat the second condenser evaporator arrangement.

19. The process according to claim 1, wherein the two-phase stream formed by the partial liquefaction has a vapor molar fraction of 0.7 to 0.95, relative to the total amount of the two-phase stream.

* * * * *